United States Patent [19]

Heynisch

[11] Patent Number: 4,647,816

[45] Date of Patent: Mar. 3, 1987

[54] TRAVELLING-WAVE TUBE AND METHOD FOR THE MANUFACTURE THEREOF

[75] Inventor: Hinrich Heynisch, Graefelfing, Fed. Rep. of Germany

[73] Assignee: Siemens Aktiengesellschaft, Berlin and Munich, Fed. Rep. of Germany

[21] Appl. No.: 671,936

[22] Filed: Nov. 16, 1984

[30] Foreign Application Priority Data

Feb. 28, 1984 [DE] Fed. Rep. of Germany ..... 3407206

[51] Int. Cl.[4] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,634,723 | 1/1972 | Gross et al. | 315/3.5 |
| 3,670,196 | 6/1972 | Smith | 315/3.5 |
| 4,158,791 | 6/1979 | Lien et al. | 315/3.5 |
| 4,185,225 | 1/1980 | Dehler et al. | 315/3.5 |
| 4,229,676 | 10/1980 | Manoly | 315/3.5 |
| 4,243,914 | 1/1981 | Delorg et al. | 315/3.5 |
| 4,264,842 | 4/1981 | Galuppi | 315/3.5 |
| 4,268,778 | 5/1981 | Friz | 315/3.5 |
| 4,292,566 | 9/1981 | Heynisch et al. | 315/3.5 |
| 4,422,012 | 12/1983 | Kosmahl | 315/3.5 |

FOREIGN PATENT DOCUMENTS 2838515 11/1981 Fed. Rep. of Germany .

*Primary Examiner*—David K. Moore
*Assistant Examiner*—M. Razavi

[57] ABSTRACT

A travelling-wave tube comprising a delay line in the form of a helix line which is disposed inside of a solid metal vacuum envelope. A high-performance travelling-wave tube whose delay line is distinguished by very good dissipation of the stray heat. A large bandwidth results by providing the delay line with a core of insulator material which has a metal layer at its inside and outside generated surfaces.

13 Claims, 2 Drawing Figures

TRAVELLING-WAVE TUBE AND METHOD FOR THE MANUFACTURE THEREOF

BACKGROUND OF THE INVENTION

The invention relates to a travelling-wave tube wherein a delay line on which RF is imposed and which is in the form of a helix is positioned between an electron beam generator and a target.

Travelling-wave tubes comprising a helix-like delay line accommodated within a vacuum envelope are known, for example, from the German Letters Pat. No. 19 37 704, corresponding to U.S. Pat. No. 3,634,723, incorporated herein by reference. Given these travelling-wave tubes, a plurality of mounting rods of dielectric material which have good thermal contact to the vacuum envelope are disposed parallel to one another along generated lines of the delay line.

It is likewise already known to manufacture the vacuum envelope and the delay line of copper and to solder these parts to the mounting rods which is formed of dielectric material, for example beryllium oxide (German Letters Pat. No. 28 38 515, incorporated herein by reference).

It is further known to allow the vacuum envelope which has first been expanded by means of heating to shrink onto the mounting rods (German Letters Pat. No. 19 37 704, incorporated herein by reference).

SUMMARY OF THE INVENTION

An object of the invention is to create a high performance travelling-wave tube whose delay line is distinguished by extremely good dissipation of the stray heat and great bandwidth.

This object is achieved by means of a travelling-wave tube comprising a delay line formed as a core of insulator material provided with a metal layer at its inside and outside generated surfaces.

The invention has the significant advantage that, due to the creation of a double-layer (helix-like) delay line, it is achieved that the inner layer of the delay line is shielded from the outer jacket thereof in such fashion that the RF field strength in the interior retains relatively high values, i.e. cannot be reduced by the influence of the metallic outside wall. A high interaction factor between the electron beam and the electro-magnetic wave is obtained given the best possible, radial heat dissipation. The technology applied is relatively good and can be governed in a cost-favorable manner.

It can also be expedient to provide a multilayer system in order to further enhance the effect.

The invention shall be explained in greater detail with reference to illustrative embodiments. Parts which do not necessarily contribute to an understanding of the invention are left unreferences in the drawing or have been omitted.

DESCRIPTION OF THE PREFERRED EMBODIMENTS

Figure 1:
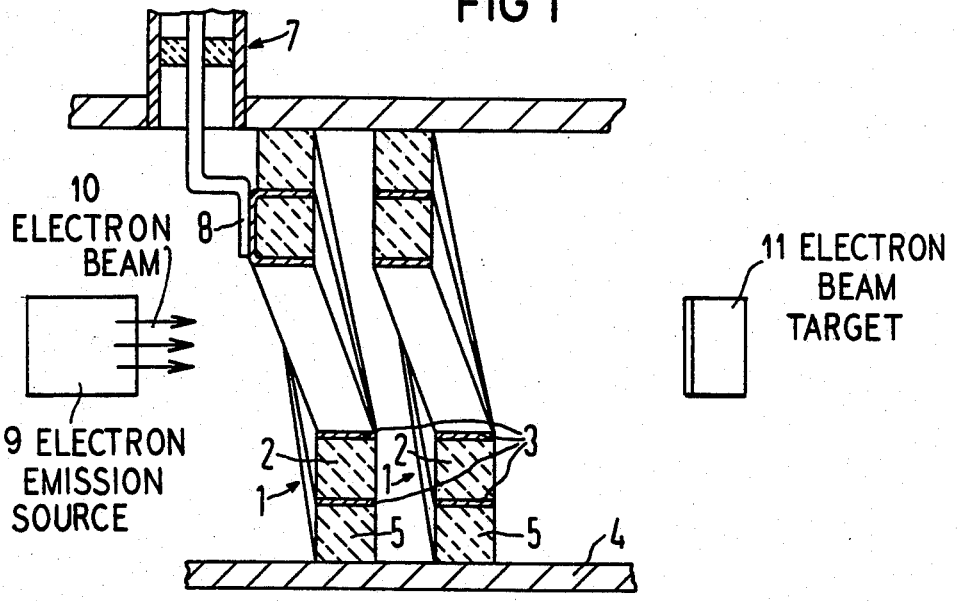
FIG. 1 illustrates the delay line of the travelling-wave tube of the invention, and is shown schematically and in partial section.

FIG. 1 shows a delay line 1 which is positioned inside of a solid metal vacuum envelope 4. An electron beam source 9 with emitted electron beam 10 and corresponding electron beam target 11 are also provided. The vacuum envelope preferably is formed of copper. In this illustrative embodiment, the delay line 1 has the shape of a helix or ring-web. The core 2 of the helix is formed of an insulator material, preferably of aluminum oxide ceramic. On its inside and outside generated surfaces, the core 2 is covered with a metal layer 3 which preferably is formed of copper. The inner metal layer 3 thereby assumes the function of a delay line and the outer metal layer 3 serves as shielding from the vacuum envelope 4. A boots of the RF field within the inner metal layer 3 (inner layer helix) is thus achieved, i.e. at the location of the electron beam. Insulating layers 5 which preferably are formed of aluminum oxide ceramic provide a radial heat dissipation. They are located between the outside generated surfaces of the delay line 1 provided with the metal layer 3 and the vacuum envelope 4. The RF in-coupling or out-coupling occurs, for example, via a coaxial waveguide 7 whose inner conductor in this illustrative embodiment is attached to the outside of the helix such that an electrical connection of the inner metal layer 3 is formed. The inner conductor 8, however, can also be contacted only to the inner metal layer 3.

Figure 2:
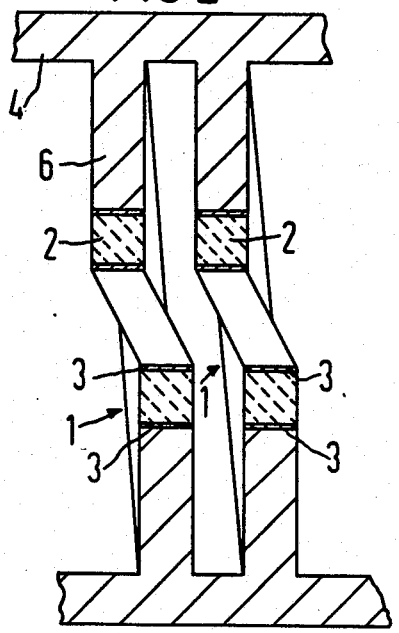
FIG. 2 is a further illustrative embodiment of the delay line of the travelling-wave tube of the invention shown schematically in partial section.

Given the illustrative embodiment shown in FIG. 2, the vacuum envelope 4 comprises a spiral groove so that a screw-shaped structure 6 arises whose inside generated surfaces are connected to the metal layer 3 on the outside generated surfaces of the delay line 1. In this illustrative embodiment, the heat dissipation occurs via the metal paths of the screwshaped structure 6 instead of via the insulating layers 5 of FIG. 1. A helix again serves as a delay line 1, the core thereof preferably being formed of aluminum oxide ceramic covered with a metal layer on its inside and outside generated surfaces.

Although various minor changes and modifications might be proposed by those skilled in the art, it will be understood that I wish to include within the claims of the patent warranted hereon all such changes and modifications as reasonably come within my contribution to the art.

I claim as my invention:

1. A travelling-wave tube, comprising:

an electron beam generating system;

a delay line in the form of a helix or ring-web shaped line supported inside of a solid metallic vacuum envelope between an electron beam generating system and an electron beam target; and said delay line comprising a core of insulator material provided with a metal layer at its inside and outside generated surfaces, said outside generated surface metal layer being spaced from the envelope and sheilding the inside surface metal layer functioning as a delay line from the metallic vacuum envelope.

2. A travelling-wave tube of claim 1 wherein at least one further metal layer insulated from said metal layer is provided.

3. A travelling-wave tube of claim 1 wherein said core comprises aluminum oxide ceramic.

4. A travelling-wave tube of claim 1 wherein said metal layer comprises copper.

5. A travelling-wave tube of claim 1 wherein an insulating layer is provided between the outside generated surface of said delay line provided with said metal layer and said vacuum envelope.

6. A travelling-wave tube of claim 5 wherein said insulating layer comprises aluminum oxide ceramic.

7. A travelling-wave tube of claim 1 wherein said vacuum envelope comprises a spiral groove forming a screw-shaped internal structure, an inside generated surface thereof being connected to said metal layer on said outside generated surface of said delay line.

8. A travelling-wave tube, comprising:

an electron beam generating system;

an electron beam target;

a delay line in the form of a helix formed within a metal envelope; and said delay line comprising an insulating layer with a metal layer at inside and outside surfaces thereof so as to form a helical inner metal layer functioning as a delay line which is shielded from the metal envelope by an outer helical metal layer spaced from the metal envelope.

9. A travelling-wave tube according to claim 8 wherein the helix is essentially supported by radially outwardly extending insulating portions.

10. A travelling-wave tube according to claim 8 wherein the helix is supported centrally of the envelope by metal projections.

11. A travelling-wave tube according to claim 8 wherein the helix is centrally supported by radially extending supporting members of a width approximately the same as the metal layers.

12. A method for manufacture of a delay line in a travelling-wave tube positioned between an electron beam generating system and an electron beam target, comprising the steps of:

coating a tube of insulating material with a metal layer at its inside and at its outside surface;

cutting away the tube so as to form a helix; and soldering the helix which forms the delay line into a metal envelope to support means contained within the envelope for positioning the delay line and for spacing the outside surface metal layer from the envelope, said inside surface metal layer functioning as a delay line which is shielded from the metal envelope by the outside surface metal layer.

13. A method according to claim 12 including the steps of providing in an interior of the metal vacuum envelope projections from inner surfaces of the envelope running in a helical pattern.

* * * * *